US006220692B1

(12) United States Patent
Iwaya et al.

(10) Patent No.: US 6,220,692 B1
(45) Date of Patent: Apr. 24, 2001

(54) INK JET RECORDING APPARATUS

(75) Inventors: Satoshi Iwaya; Atsushi Nishioka, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/354,115

(22) Filed: Jul. 15, 1999

(30) Foreign Application Priority Data

Jul. 15, 1998 (JP) ..... 10-201009

(51) Int. Cl.[7] ..... B41J 2/165
(52) U.S. Cl. ..... 347/33; 347/29
(58) Field of Search ..... 347/33, 29, 23

(56) References Cited

U.S. PATENT DOCUMENTS

| | | | | |
|---|---|---|---|---|
| 4,695,851 | | 9/1987 | Terasawa | 347/30 |
| 4,739,847 | | 4/1988 | Terasawa | 177/140 |
| 5,260,724 | | 11/1993 | Tomii et al. | 347/32 |
| 5,523,848 | * | 6/1996 | Musso et al. | 358/296 |
| 5,587,729 | | 12/1996 | Lee et al. | 347/32 |
| 5,831,644 | * | 11/1998 | Kato | 347/22 |
| 6,007,179 | * | 12/1999 | Ohtani et al. | 347/30 |

FOREIGN PATENT DOCUMENTS

| | | | |
|---|---|---|---|
| 0 785 084 | | 7/1997 | (EP) . |
| 0 818 317 A2 | | 1/1998 | (EP) . |
| 0 916 508 | | 5/1999 | (EP) . |
| 2 768 078 | | 3/1999 | (FR) . |
| 178063 | | 9/1985 | (JP) . |
| 6-262768 | * | 9/1994 | (JP) . |
| 8-25280 | | 3/1996 | (JP) . |
| 8-25281 | | 3/1996 | (JP) . |

OTHER PUBLICATIONS

European Search Report Application # 99113679.7–2304–, May 24, 2000.

* cited by examiner

*Primary Examiner*—N. Le
*Assistant Examiner*—Shih-Wen Hsieh
(74) *Attorney, Agent, or Firm*—Nixon & Vanderhye P.C.

(57) ABSTRACT

To propose an ink-jet recording apparatus having a small-sized compact driving mechanism for driving an ink suction pump, an elastic blade for wiping a recording head, and a locking arm for locking a carriage. An ink suction pump 8, a locking arm for locking a carriage, and an elastic blade for wiping a recording head are driven by a driving mechanism for common use. The driving mechanism transmits the torque of a single motor via a driving gear to the ink suction pump. Moreover, the driving mechanism also converts the rotary motion into the locking movement of the elastic blade via a rotary cam plate frictionally engaging with the driving gear and further converts the locking movement of the elastic blade to the locking movement of the locking arm. The ink-jet recording apparatus can be made small-sized and compact by driving each driven portion using the driving mechanism for common use.

6 Claims, 7 Drawing Sheets

INK JET RECORDING APPARATUS

BACKGROUND OF INVENTION

1. Field of Invention

This invention relates to an ink-jet recording apparatus and more particularly to a carriage locking mechanism for locking a recording-head carrying carriage.

2. Related Art

An ink-jet recording apparatus is used for printing on a recording medium by sending a jet of ink drops out of ink nozzles of a recording head while reciprocating a recording-head carrying carriage within a predetermined range. When no printing is occurring, the carriage is kept on stand-by in the home position outside the printing range. In the stand-by condition, the nozzle-forming surface of the recording head is covered with a cap to prevent increasing ink viscosity as the ink dries, or to prevent entrance of air from the outside. While the recording head is covered with the cap, an ink suction pump is driven periodically to discharge thickened ink and air outside by sucking the ink from the ink nozzles of the recording head. In addition, an elastic blade is used to wipe off foreign materials such as paper dust and ink sticking to the nozzle-forming surface of the recording head.

When ink is sucked from the recording head by driving the ink suction pump, the recording head must be set at the predetermined position so that the cap will not slip off the recording head. It is then necessary to lock the carriage containing the recording head in the home position and prevent the cap from undesirably slipping off the recording head. In the home position, the carriage can often be released from this position due to vibration, shock, a power cut or the like.

Mounting the ink suction pump, the carriage locking mechanism, and the head wiping member tends to increase not only the dimensions of the apparatus but also its production cost to the extent that they are mounted. It is therefore desirable to make such mechanisms as an ink suction pump, a carriage locking mechanism and a mechanism for driving a head wiping member small-sized and compact.

SUMMARY OF INVENTION

Various implementations of the invention may include one or more of the following features.

In general, in one aspect, the invention features an ink-jet recording apparatus that performs printing of images or characters on a recording medium by moving a carriage having a recording head for ejecting ink drops, which includes a locking mechanism capable of locking the carriage in a predetermined position, an ink suction pump for sucking ink from ink nozzles of the recording head while the carriage is set at the predetermined position, a head wiping member for wiping off foreign materials from the nozzle-forming surface of the recording head which moved by the carriage, and a driving mechanism for common use in driving the locking mechanism, the ink suction pump and the head wiping member.

In an implementation, the head wiping member may include an elastic blade capable of moving between a forward position where the head wiping member is in contact with the nozzle-forming surface and a backward position where the head wiping member is away from the nozzle-forming surface, and the locking mechanism may also include a locking lever having an engaging portion is capable of moving between a locked position where the engaging portion is engaged with the carriage and an unlocked position where engaging portion is release therefrom.

In another implementation, the driving mechanism may include a motor and a power transmission mechanism for transmitting the driving force of the motor to the ink suction pump, the locking lever and the elastic blade, and the power transmission mechanism may also include a rotary-motion transmission mechanism for transmitting the rotary motion of the motor to the ink suction pump, a first conversion mechanism for converting the rotary motion into the reciprocating movement of the elastic blade, and a second conversion mechanism for converting the reciprocating movement of the elastic blade into the locking motion of the locking arm.

In another implementation, the rotary motion of the rotary-motion transmission mechanism is transmitted to the first conversion mechanism by the frictional force obtained from a spring member. With this arrangement, there occurs a slide between the rotary-motion transmission mechanism and the first conversion mechanism when the movement of the elastic blade or the locking arm as a driven member is blocked, and the rotary motion is not transmitted. Therefore, the driving control of each portion can be accomplished by a simple mechanism because the elastic blade or the locking arm as a driven member can be stopped at any desired position, irrespective of the driving condition of the motor or the ink suction pump.

In order to drive the ink suction pump, on the other hand, the carriage needs locking by means of the locking arm prior to driving the ink suction pump. When the elastic blade is used to wipe the recording head, however, the carriage will have to be moved by releasing the locked condition of the carriage while the elastic blade is held in the forward position.

In another implementation, a mechanism is provided for converting the reciprocating movement of the reciprocating member on the elastic blade side by means of the second conversion mechanism into the locking motion of the locking arm, the locking motion of the locking arm is regulated so that when the elastic blade advances up to the mid position between the backward and forward positions, the locking arm will rock from the unlocked position up to the locked position and that when the elastic blade advances further up to the forward position, the locking arm will rock up to the unlocked position.

In another implementation, the rotary-motion transmission mechanism may include a gear train for coupling the motor and the ink suction pump, the first conversion mechanism may include a rotary cam plate which is press-fixed coaxially by spring force to a driving gear included in the gear train, an arcuate cam groove formed on the side of the rotary cam plate, a cam follower which is slidable in the arcuate cam groove, a reciprocating member with the cam follower fitted to the rear end of the reciprocating member, and a guide portion for supporting the reciprocating member between the forward and backward positions so that the reciprocating member may reciprocate linearly, and the second conversion mechanism may also include a locking-arm engaging portion fitted to the reciprocating member, a locking shaft for supporting the locking arm so as to make the locking arm capable of locking within a predetermined angle range, and an engaging portion engaging with the locking-arm engaging portion.

In another implementation, the ink suction pump may include a circular inner circumferential face, a flexible ink tube which is placed along the circular inner circumferential face, a roller, and a cam roller which is rolled along the circular inner circumferential face while the roller is held against the ink tube. In this case, the driving gear is coupled to the cam rotor of the ink suction pump so that the driving gear may be rotated in a way integral therewith when the locking arm reaches the locking position after the rotary cam plate of the first conversion mechanism together with the driving gear of the rotary-motion transmission mechanism is rotated by a predetermined angle.

The invention may provide one or more of the following advantages.

As set forth above, the driving mechanism for common use is employed for driving the ink suction pump, the carriage locking mechanism and the head wiping member, so that the ink-jet recording apparatus can be made small-sized and less costly by utilizing a common power transmission path for driving each portion, in comparison with the provision of individual driving mechanisms. Moreover, control of driving each portion becomes simplified because any operation to time the driving of the individual driving mechanisms can be dispensed with.

Further details of an ink jet recording apparatus suitable for use in further embodiments are disclosed in U.S. application entitled, "Ink Jet Recording Apparatus and Method", assigned to the same assignee, Seiko-Epson Corporation, filed on the same date, and with priority based on Japanese Patent Application Hei. 10-201010, filed Jul. 15, 1998.

The details of one or more embodiments are set forth in the accompanying drawings and the description below. Other features, objects, and advantages of the invention will be apparent from the description and the drawings, and from the claims.

DETAILED DESCRIPTION OF PREFERRED EMBODIMENTS

Figure 1:
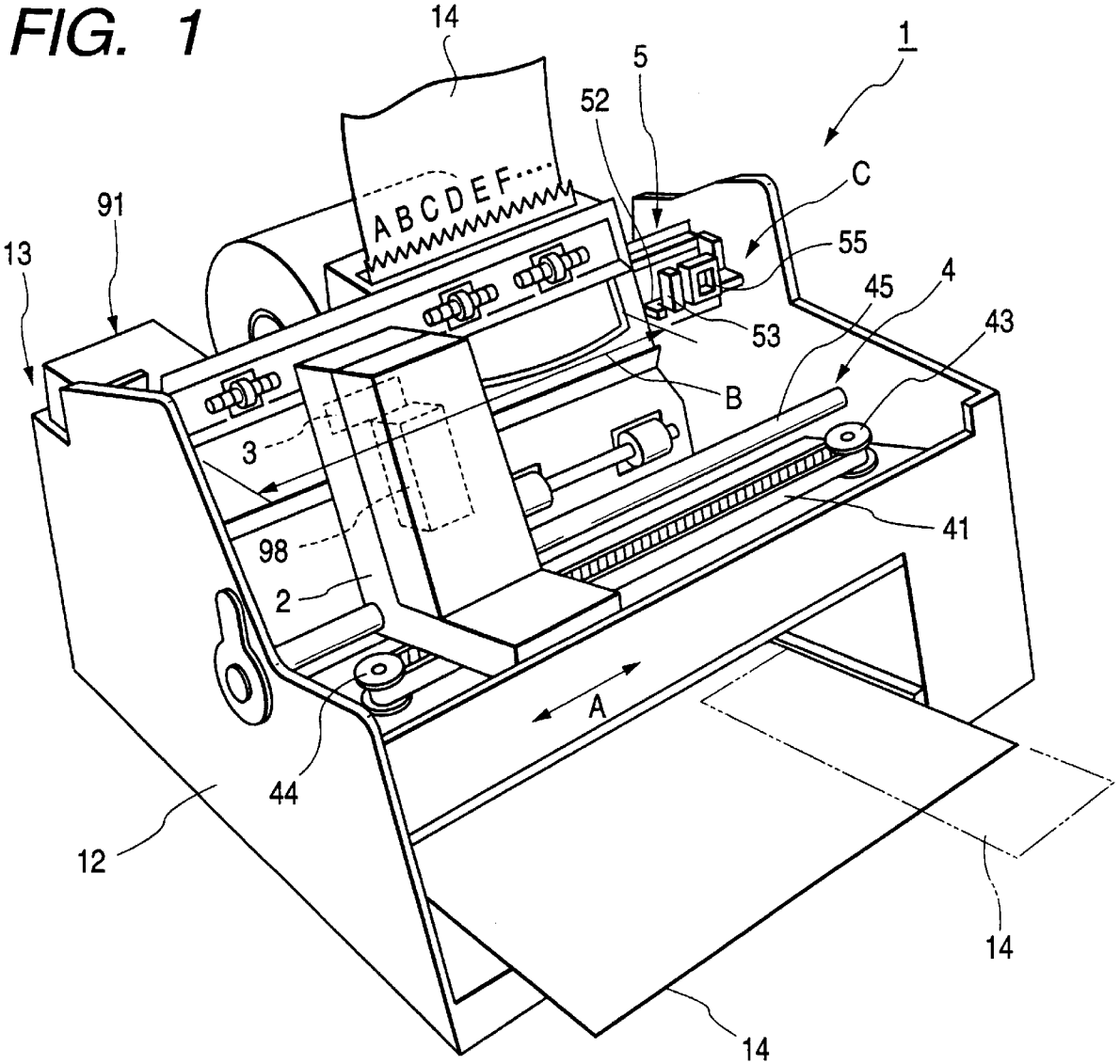
FIG. 1 is a perspective view of an implementation of an ink-jet recording apparatus.

In FIG. 1, an ink-jet recording apparatus 1 has a recording head 3 for producing a jet of ink drops, a carriage 2 for carrying the recording head 3, a carriage moving mechanism 4 for moving the carriage 2 in the scanning direction shown by an arrow A, and an ink supply mechanism 9 for supplying ink to the recording head 3.

The recording head 3 is fitted with nozzle-forming surface 32 where a plurality of nozzles 31 for jetting out ink, the nozzle-forming surface 32 is exposed outside through a rectangular opening 30.

Figure 2:
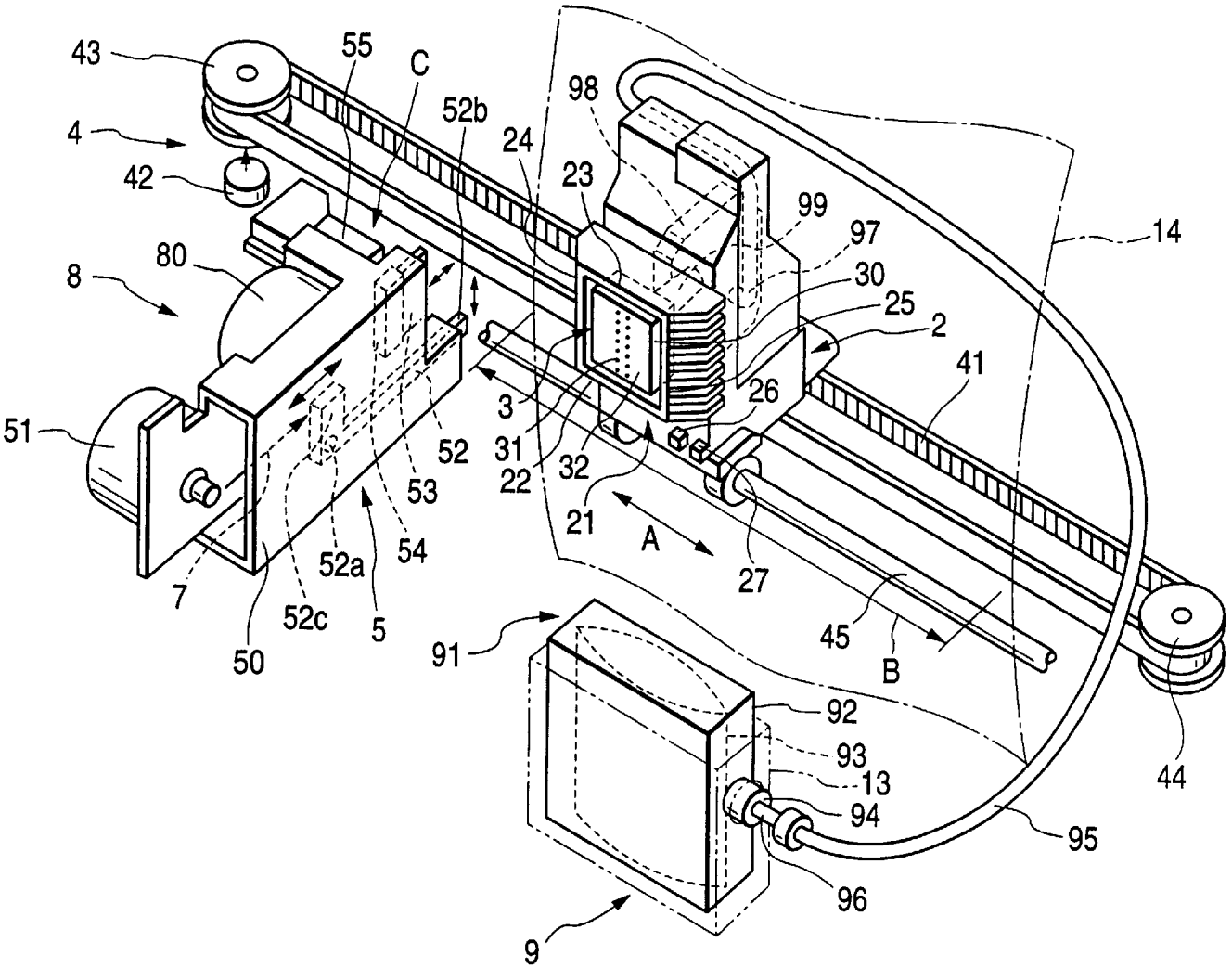
FIG. 2 is a perspective view of a principal part of the apparatus shown in FIG. 1.

As shown in FIG. 2, the carriage moving mechanism 4 is fitted with a guide shaft 45, a timing belt 41 stretched between a drive-side pulley 43 and a driven-side pulley 44, and a carriage motor 42 for driving the drive-side pulley 43 to rotate. The underside portion of the carriage 2 is slidably supported relative to the guide shaft 45 and coupled to the timing belt 41. When the timing belt 41 is rotated and moved by the carriage motor 42, the carriage 2 is moved along the guide shaft 45 in the scanning direction A.

While the carriage 2 is moving in the scanning direction A, the ink supplied from the ink supply mechanism 9 is jetted out of the nozzles 31 of the recording head 3. Recording paper 14 is conveyed to a position facing the nozzle-forming surface 32 and characters are recorded on the surface of the recording paper 14 with the jetted ink drops.

The ink supply mechanism 9 has an ink cartridge 91 detachable from an ink-cartridge fitting portion 13 formed in the body 12 of the ink-jet recording apparatus 1, a pressure attenuator 98 mounted on the carriage 2, and an ink supply tube 95 connecting the ink cartridge 91 and the pressure attenuator 98.

The ink cartridge 91 is formed with a flexible ink bag 93 contained in a rigid case 92. An ink supply needle 96 fitted to one end portion of the ink supply tube 95 is connected to an ink takeout port 94 formed in the ink bag 93. The other end portion 97 of the ink supply tube 95 is connected to the pressure attenuator 98. Further, the leading end portion of an ink outlet path 99 formed in the pressure attenuator 98 is connected to the recording head 3. Consequently, the ink stored in the ink bag 93 of the ink cartridge 91 is supplied via the ink supply tube 95 to the pressure attenuator 98 before being sent to the recording head 3. Then the ink supplied to the recording head 3 is jetted out of the ink nozzles 31.

A head maintenance unit 5 is located in a position facing the home position of the carriage 2 shown by an arrow C. The head maintenance unit 5 is fitted with an ink suction pump 8 for discharging thickened ink, residual bubbles and the like from the ink nozzles 31 of the recording head 3 outside when the carriage 2 is moved to the home position C. The head maintenance unit 5 is also provided with an elastic blade 53 forming a head wiping member for wiping off ink and foreign materials such as paper dust sticking to the nozzle-forming surface 32 of the recording head 3. Further, the head maintenance unit 5 is equipped with a locking arm 52 forming a carriage locking mechanism for fixing the carriage 2 to the home position C.

The ink suction pump 8, the elastic blade 53 and the locking arm 52 are driven by a common driving mechanism 7 provided to a unit case 50. Prior to describing the constitution of the common driving mechanism 7, the construction of the ink suction pump 8, the elastic blade 53 and the locking arm 52 will be described first.

In an embodiment, the ink sucking pump 8 sucks ink similar to a pump disclosed in EP 0 818 317 A2.

Figure 3A:
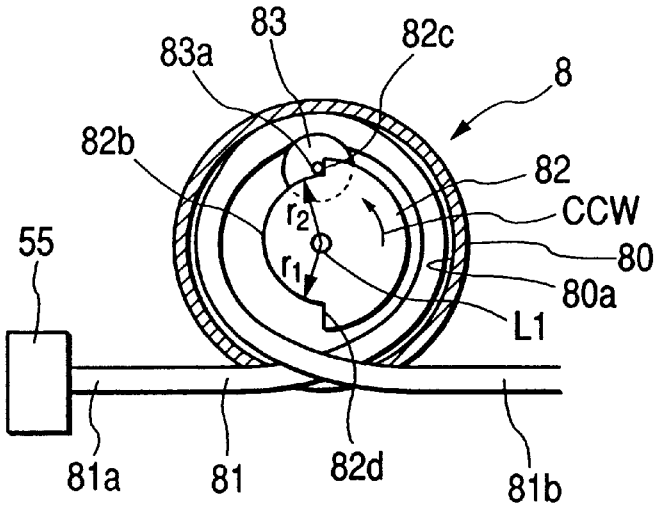
FIG. 3A is a diagram illustrating the internal construction and operation of the ink suction pump mounted in the apparatus of FIG. 1.
Figure 3B:
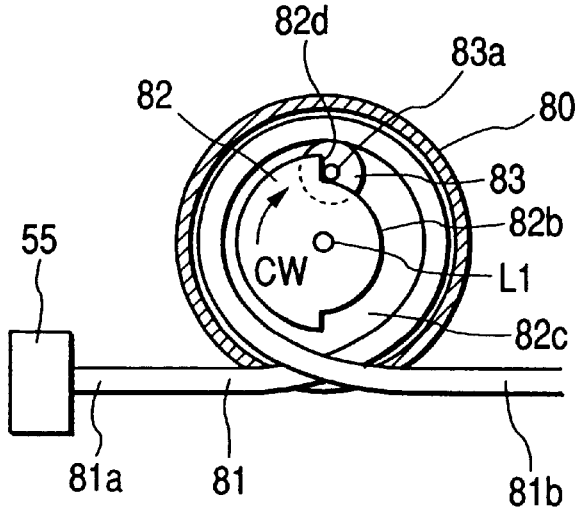
FIG. 3B is a diagram illustrating the internal construction and operation of the ink suction pump mounted in the apparatus of FIG. 1.

FIGS. 3A and 3B are exemplary diagrams illustrating the internal construction and operation of the ink suction pump 8. The ink suction pump 8 is fitted with a cylindrical case 80 having a circular inner circumferential face 80*a,* a flexible ink tube 81 wound on the circular inner circumferential face 80*a* once, a cam rotor 82 for the pump, and a roller 83 which is pushed by the cam rotor 82 to roll along the circular inner circumferential face 80*a* while the roller 83 is squashing the ink tube 81 flat.

The center of rotation of the cam rotor 82 for the pump conforms to the center of the circular inner circumferential face 80*a,* and a small-diameter arcuate cam face 82*b* ranging over about 180 degrees is formed on the outer circumferential face. This arcuate cam face 82*b* has a curvature radius that is r1<r2 in the counterclockwise direction around the center of rotation L1 and that increases gradually from r1 to r2. Stepped faces 82*c* and 82*d* for connecting both ends of the cam face 82 and the remaining large-diameter outer circumferential face are formed at both the ends of the cam face 82*b,* respectively. The rotary shaft 83*a* of the roller 83 is pushed by the stepped faces 82*c* and 82*d* of the cam rotor 82 and capable of rolling along the cam face 82*b.*

One end 81*a* of the ink sucking tube 81 is drawn outside from the case 80 and made to communicate with a cap 55 that is used to cover the nozzle-forming surface 32 of the recording head 3 at the time sucking ink. The other end 81*b* of the ink suction tube 81 is drawn outside from the substantially same place of the case 80 likewise and connected to a waste ink tank (not shown).

The operation of the ink suction pump 8 thus constructed will now be described. A capping mechanism according to this embodiment of the invention is similar to the device disclosed in U.S. Pat. No. 5,260,724. When the carriage 2 is moved up to the home position C, the cap 55 is moved forward from the unit case 50 in the way interlocked with the movement of the carriage 2 to cover the nozzle-forming surface 32 of the recording head 3. When the cam rotor 82 for the pump is rotated counterclockwise in that condition, the roller 83 is pushed out by the cam face 82*b* of the cam rotor 82 toward the ink tube 81 and made to squash the ink tube 81 flat. While that condition is sustained, the roller 83 is pushed by the stepped face 82*c* of the cam rotor 82 in the circumferential direction. As a result, the roller 83 rolls counterclockwise while squashing the ink tube 81 flat. Thus, ink is sucked from the ink nozzles of the recording head 3 because a side communicating with the cap 55 of the ink tube 81 becomes vacuous.

Conversely, the roller 83 is moved to the central side in accordance with the cam face 82*b* of the cam rotor 82 when the cam rotor is rotated clockwise, so that the ink tube 81 squashed flat by the roller 83 is restored to the original condition. As shown in FIG. 3B, the roller is pushed by the other stepped face 82*d* of he cam rotor 82 and made to roll clockwise. In this case, no pumping action is performed in the ink suction pump 8.

The elastic blade 53 is capable of reciprocating movement between a forward position where the elastic blade 53 contacts the nozzle-forming surface 32 of the recording head 3 and a backward position where it does not contact the nozzle-forming surface 32 thereof. The elastic blade 53 is rectangular and as thick as prescribed and held by a blade holding member 54.

When the carriage 2 is moved from a printing area B to the home position C while the elastic blade 53 is held at the forward position, the leading end portion of the elastic blade 53 is brought into contact with the nozzle-forming surface 32, whereby ink and foreign materials such as paper dust sticking to the nozzle-forming surface 32 are wiped off.

Referring again to FIG. 2, the locking arm 52 is fitted with a carriage engaging end 52*b*. The locking arm 52 rocks with the reciprocating movement of the elastic blade 53. A pair of locking-arm engaging portions 26 and 27, formed on the side of the carriage 2, are projections directed to the direction of moving the carriage and arranged with a predetermined space held therebetween. In an implementation, the carriage engaging end 52*b* moves from a locked position where it has engaged with locking-arm engaging portions 26 and 27, to an unlocked position where it has come off the locking-arm engaging portions 26 and 27.

The carriage engaging end 52*b* of the locking arm 52 is rotated from the upper side to the lower side so that the carriage engaging end 52*b* can enter between the pair of the locking-arm engaging portions 26 and 27. This position of the locking arm 52 is the locked position where the carriage 2 is locked and any other position of the locking arm 52 is the unlocked position.

Figure 4A:
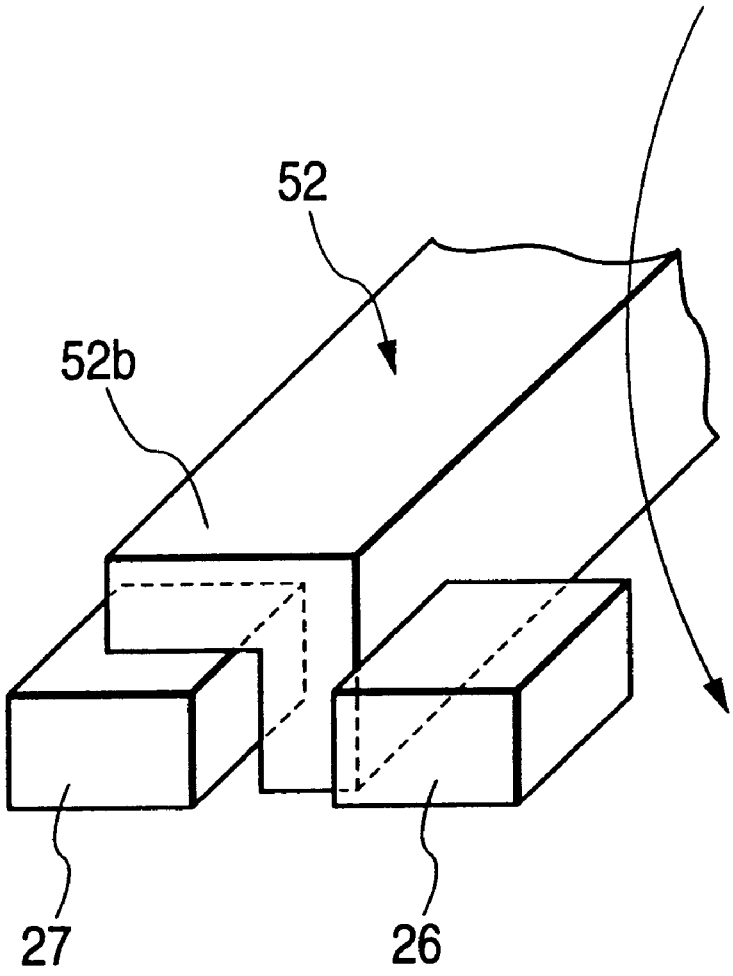
FIG. 4A is a diagram illustrating the locked condition of a carriage by an implementation of a locking arm in the apparatus of FIG. 1.

In an implementation the sectional shape of the carriage engaging end 52*b* of the locking arm 52 is such that one end of the locking direction is set wide. As shown in FIG. 4A, for example, the carriage engaging end 52*b* is L-shaped in cross section with the upper end side being set wide. When the locking arm 52 rocks from the upper side to the lower side as shown by an arrow so as to enter between the pair of locking-arm engaging portions 26 and 27, its wide portion comes in contact with the one engaging portion 27. Consequently, the locking arm 52 is blocked from locking further and held to be clamped between the pair of engaging portions 26 and 27. The locking arm 52 is released from the locked condition only when it is rocked upward. FIG. 4B illustrates a front view of the locking arm 52 and engaging portions 26 and 27 of FIG. 4A.

Figure 4D:
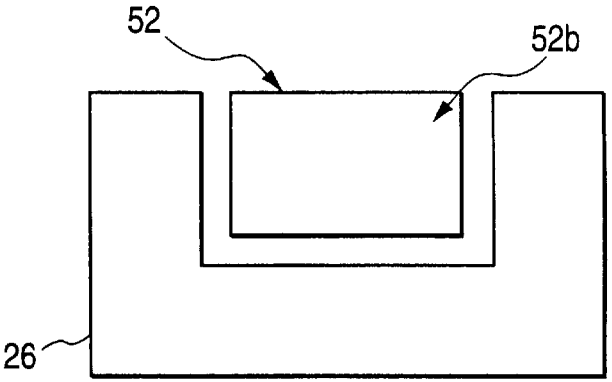
FIG. 4D is a front view of an alternate implementation of a locking arm mechanism.
Figure 4E:
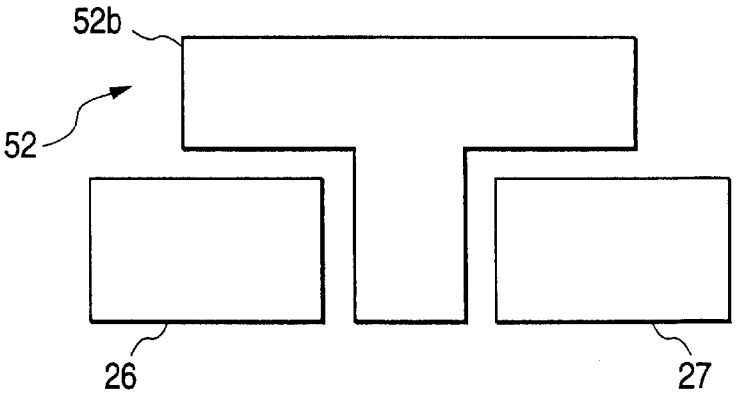
FIG. 4E is a front view of an alternate implementation of a locking arm mechanism.
Figure 4B:
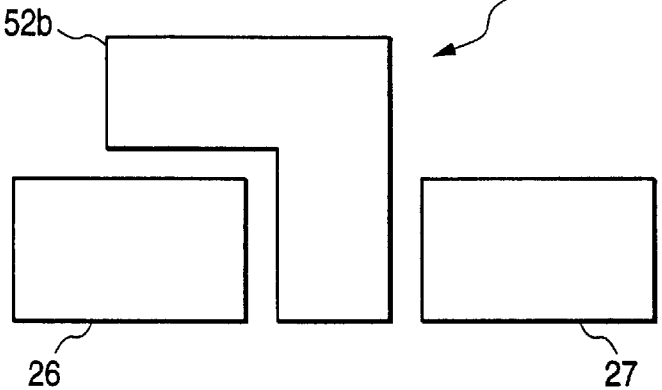
FIG. 4B is a front view of the apparatus of FIG. 4A.
Figure 4C:
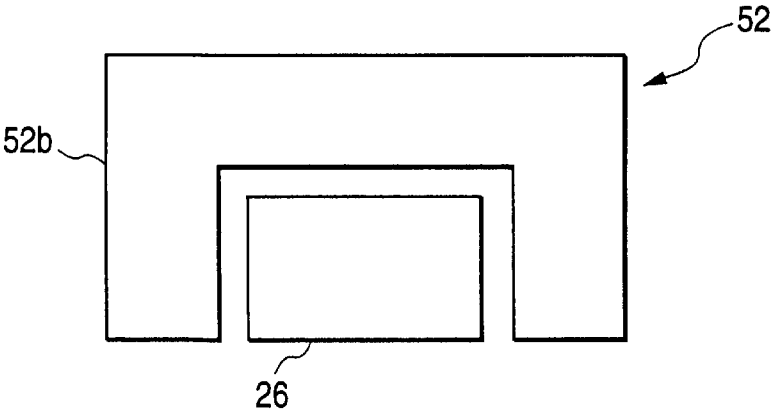
FIG. 4C is a front view of an implementation of a locking arm mechanism.

FIGS. 4C–4E illustrate alternate embodiments of the locking arm 52. FIG. 4C illustrates the locking arm 52 with a carriage engaging end 52*b* which has a generally rectangular shape but has a concave opening 52*d* adapted to receive a single locking-arm engaging portion 26. In this embodiment the single locking-arm engaging portion 26 is rectangular in shape. FIG. 4D illustrates the locking arm 52 with a carriage engaging end 52*b* which is rectangular in shape and is adapted to receive a single locking-arm engaging portion 26. In this embodiment the single locking-arm engaging portion 26 is generally rectangular in shape but has a concave opening 52*e* adapted to receive the carriage engaging end 52*b*. FIG. 4E illustrates the locking arm 52 with a carriage engaging end 52*b* which is in a "T" shape. Locking arm-engaging portions 26 and 27 are adapted to receive the carriage engaging end 52*b*.

The driving mechanism 7 for driving the ink suction pump 8, the elastic blade 53 and the locking arm 52 will subsequently be described by reference to FIG. 5.

The driving mechanism 7 according to this embodiment is fitted with a single motor 51, and power transmission mechanism 60 for transmitting the driving force of the motor 51 to the ink suction pump 8, the elastic blade 53 and the locking arm 52.

The power transmission mechanism 60 is fitted with a reduction gear train as a rotary-motion transmission mechanism for transmitting the rotary motion of the motor 51 to the ink suction pump 8. In an embodiment, the gear train includes a pinion 71 fitted to the output shaft of the motor 51, an idle gear 72 meshing with the pinion 71, a pinion 73 formed coaxially and integrally with the idle gear 72, and a driving gear 74 meshing with the pinion 73.

The driving gear 74 is disposed coaxially with the cam rotor 82 of the ink suction pump 8 in a way adjacent thereto. The driving gear 74 and the cam rotor 82 are rotatably supported by a common rotary center shaft 61. Mating projections 74*a* and 82*a* are formed in the same radial position on a side respectively facing the driving gear 74 and the cam rotor 82. The cam rotor 82 together with the driving gear 74 is rotated after the driving gear 74 is rotated so as to make the mating projection 74*a* mate with the mating projection 82*a* on the side of the cam rotor 82.

Further, the power transmission mechanism 60 is provided with a first conversion mechanism for converting the rotary motion transmitted via the gear train into the reciprocating movement of the elastic blade 53. The first conversion mechanism according to this embodiment has a rotary cam plate 75 rotatably supported by the common rotary center shaft 61, which rotary cam plate 75 is pressed against the driving gear 74 by the spring force of a coil spring 76 so as to frictionally mate with the driving gear 74.

An arcuate cam groove 75*a* ranging over an angle of about 90 degrees is cut in the side of the rotary cam plate 75. A reciprocating plate 77 is coupled to the back side of the blade holding portion 54 holding the elastic blade 53, and a cam follower 77*a* sliding in the arcuate cam groove 75*a* is fitted to the rear end of the reciprocating plate 77.

A pair of slide pins 77*b* and 77*c* are projected from the side of the reciprocating plate 77, these slide pins 77*b* and 77*c* being slidable along guide holes 50*a* and 50*b* formed in the unit case 50. The reciprocating plate 77 is capable of reciprocating longitudinally within the range defined by the guide holes 50*a* and 50*b*. A position where the reciprocating plate 77 has moved to the front end of the guide hole is the forward position of the elastic blade 53 and a position where the reciprocating plate 77 has moved to the rear end of the guide hole is the backward position of the elastic blade 53.

In the first conversion mechanism, the rotary cam plate 75 coaxially and frictionally mated with the driving gear 74 is rotated together with the driving gear 74 while the first conversion mechanism is mated therewith. As the driving gear 74 rotates then, the cam follower 77*a* of the reciprocating plate 77 is slid along the cam groove 75*a*. The reciprocating plate 77 is reciprocated longitudinally as the cam groove 75*a* rotates because the direction of moving the reciprocating plate 77 is defined by the guide holes 50*a* and 50*b*.

In an embodiment, the power transmission mechanism 60 includes a second conversion mechanism for converting the reciprocating movement of the reciprocating plate 77 obtainable through the first conversion mechanism to the locking motion of the locking arm 52. The second conversion mechanism is fitted with a locking-arm engaging pin 77*d* projecting from the side of the reciprocating plate 77, a locking central shaft 52*a* for supporting the bent portion of the locking arm 52 so that the bent portion thereof may be capable of locking, and a mating groove 52*c* formed in the rear end portion of the locking arm 52. The locking-arm engaging pin 77*d* in an idle state is fitted into this mating groove 52*c*.

Figure 5:
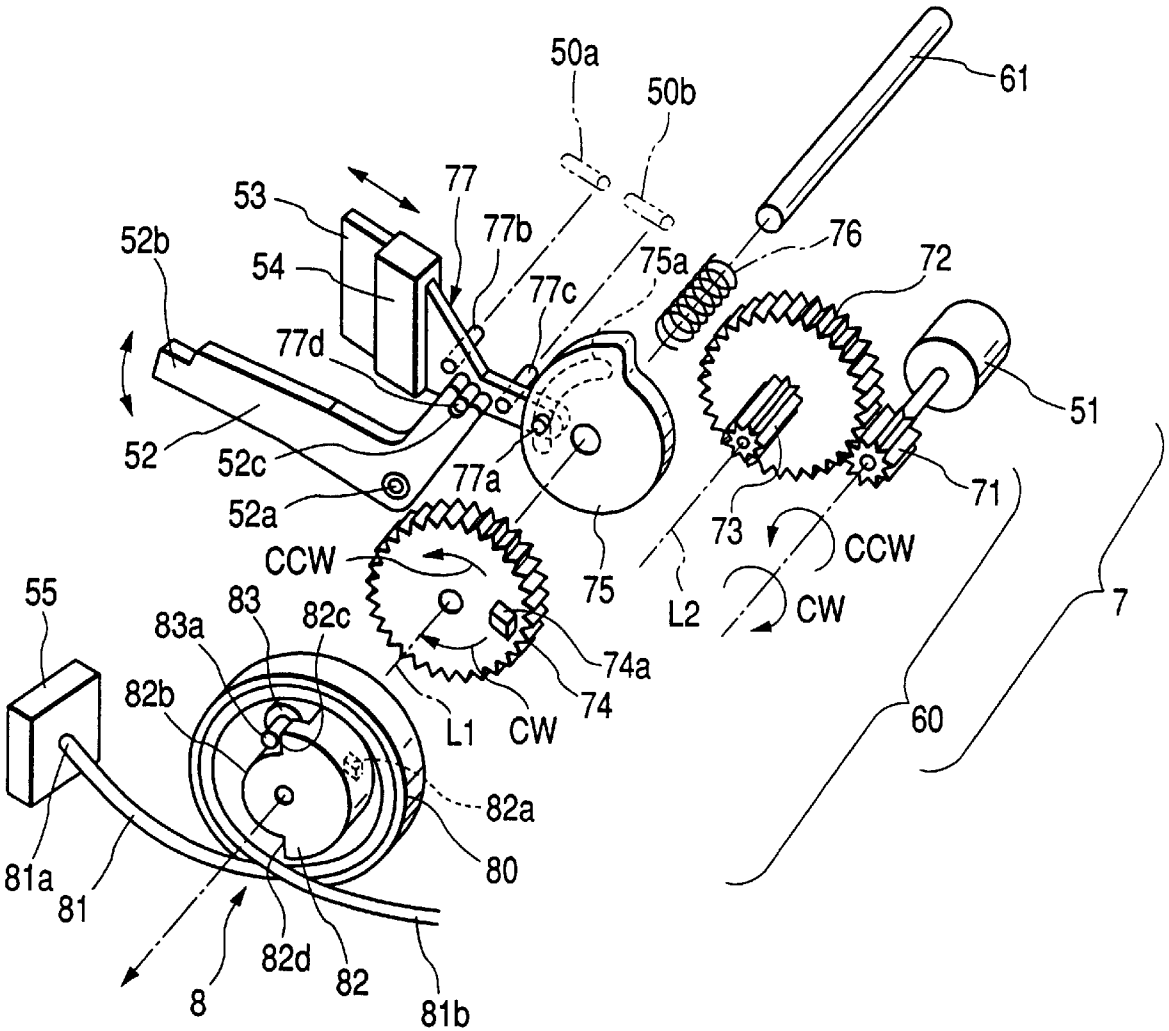
FIG. 5 is an exploded perspective view of the construction of the driving mechanism mounted in the apparatus of FIG. 1.

When the reciprocating plate 77 moves longitudinally, the locking arm 52 makes a locking motion vertically within the predetermined angle range around the locking central shaft 52*a* in the case of FIG. 5.

Figure 6A:
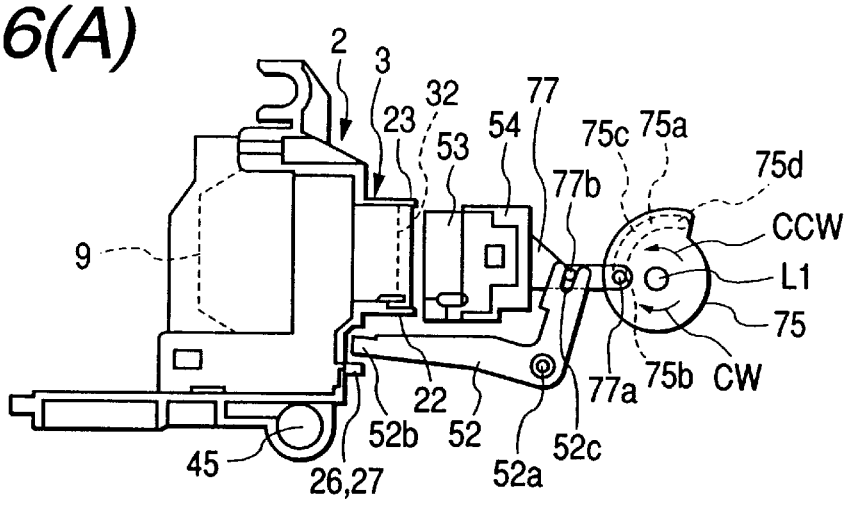
FIG. 6A is a diagram illustrating the operation of the apparatus of FIG. 1.
Figure 6B:
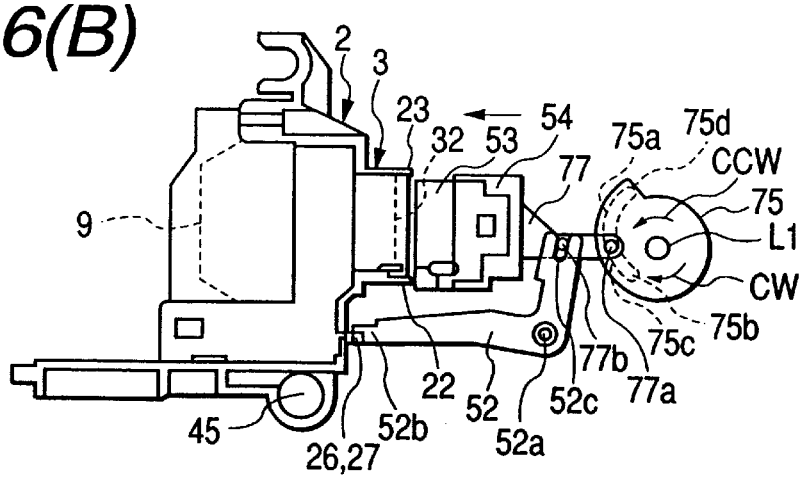
FIG. 6B is a diagram illustrating the operation of the apparatus of FIG. 1.
Figure 6C:
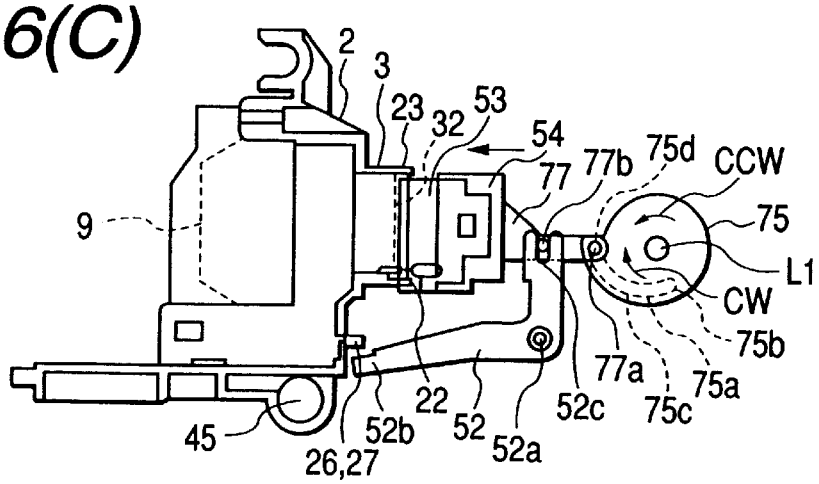
FIG. 6C is a diagram illustrating the operation of the apparatus of FIG. 1.

FIGS. 6A, 6B and 6C are operational diagrams illustrating the moving positions of the elastic blade 53 and the locking arm 52. The operation of the ink suction pump 8, the elastic blade 53 and the locking arm 52 according to this embodiment of the invention will be described by reference to these diagrams.

As shown in FIG. 6A, the cam follower 77*a* of the reciprocating plate 77 is positioned at the lower end 75*b* of the cam groove 75*a* formed in the rotary cam plate 75 during the normal printing operation. In this configuration, the elastic blade 53 stays at the backward position, and the locking arm 52 stays at the unlocked position to which the carriage engaging end 52*b* has moved higher than the moving locus of the engaging portions 26 and 27 on the carriage side.

When ink is sucked, the motor 51 is rotated counterclockwise after the carriage 2 is moved to the home position C. The torque of the motor 51 is transmitted via the gear train to the driving gear 74, and the rotary cam plate 75 frictionally engaging with the driving gear 74 is rotated together counterclockwise. Consequently, the reciprocating plate 77 is pushed forward as the cam groove 75*a* of the rotary cam plate rotates.

When the rotary cam plate 75 rotates about 45 degrees, the reciprocating plate 77 is pushed out up the mid-position in the longitudinal direction of the reciprocating plate as shown in FIG. 6B and with this movement, the carriage engaging end 52*b* as the front end of the locking arm 52 is rocked downward and the locked position is taken where the carriage engaging end 52*b* has entered between the pair of engaging portions 26 and 27 on the side of the carriage 2.

In this condition, the locking arm 52 is not allowed to rock downward further as shown in FIGS. 4A–4D. Consequently, there occurs a slide between the rotary cam plate 75 and the driving gear 74 because the rotation of the rotary cam plate 75 is blocked and only the driving gear 74 continues to rotate. Therefore, the locking arm 52 is held at the carriage locking position, irrespective of whether the motor 51 is driven.

Thus, the carriage locking is engaged by the locking arm 52. While the carriage is locked, the elastic blade 53 is in the mid-position of its movement and has not moved forward to a position where the elastic blade 53 can contact the nozzle-forming surface 32 of the recording head.

When the motor 51 is continuously rotated counterclockwise then, the rotation of the motor is transmitted via the driving gear 74 to the cam rotor 82 of the ink suction pump 8, and the cam rotor 82 is rotated counterclockwise. As a result, the operation of sucking ink by means of the ink suction pump 8 is performed and a predetermined amount of ink is sucked as illustrated by reference to FIG. 3.

When the motor 51 is rotated clockwise after the termination of suction of ink, the rotary cam plate 75 is reversely rotated and the reciprocating plate 77 is pulled backward, whereby the leading end of the locking arm 52 is rotated upward. Thus, the locked condition of the carriage is released.

In order to perform the process of wiping the elastic blade 53 then, the motor 51 is rotated counterclockwise before the carriage 2 is moved to the home position C. In this case, unlike the locking of the carriage as mentioned above, the engaging portions 26 and 27 for blocking the locking of the locking arm 52 halfway are not in the way. Therefore, the elastic blade 53 is moved up to the front end position as shown in FIG. 6C. When the carriage 2 is moved to the home position C in that condition, ink, paper dust and the like sticking to the nozzle-forming surface 32 of the recording head 3 are wiped off by the elastic blade 53.

Since the locking arm 52 has rocked downward in that condition, the carriage 2 can be reciprocated without the interference of the locking arm 52. The forward movement of the reciprocating plate 77 is blocked by the guide holes 50*a* and 50*b* in that condition, moreover, there occurs a slide between the rotary cam plate 75 and the driving gear 74, and the elastic blade 53 is held at its front end position, irrespective of where the motor 51 is driven.

The motor 51 is driven clockwise to restore the elastic blade 53 from the condition mentioned above to the original retreated condition.

The driving mechanism 7 for common use is employed for carrying out the operation of the ink suction pump 8, the reciprocating movement of the elastic blade 53 and the locking motion of the locking arm 52, so that the ink-jet recording apparatus can be made small-sized, compact and less costly in comparison with the provision of individual driving mechanisms.

In addition, the common driving mechanism 7 is made up of the single motor 51 and the power transmission mechanism 60 for transmitting the driving force of the motor 51 to the ink suction pump 8, the elastic blade 53 and the locking arm 52. The power transmission mechanism 60 includes the rotary-motion transmission mechanism for transmitting the rotary motion of the motor 51 to the ink suction pump 8, the first conversion mechanism for converting the rotary motion transmitted via the rotary-motion transmission mechanism into the reciprocating movement of the elastic blade 53, and the second conversion mechanism for converting the reciprocating movement of the elastic blade 53 into the locking motion of the locking arm 52. As the power transmission path is commonly used for every driving portion like this, the driving mechanism can be made small-sized and compact.

In an embodiment, the rotary motion of the rotary-motion transmission mechanism is to be transmitted to the first conversion mechanism by the frictional force obtainable from the coil spring 76. With this arrangement, a slide occurs between the rotary-motion transmission mechanism and the first conversion mechanism if the elastic blade 53 or the locking arm 52 as a driven side is blocked from being moved, which also interferes with the transmission of the rotary motion. Therefore, the elastic blade 53 or the locking arm 52 as a driven member can be stopped at the desired position, irrespective of the driving condition of the elastic blade 53 or the locking arm 52. Thus, the power transmission mechanism can be simplified in constitution as a synchronizing mechanism for establishing the driving timing of each driven portion is unnecessary to install separately, which also results in making the apparatus small-sized and compact.

In an embodiment, the locking motion of the locking arm 52 brought about by the reciprocating movement of the elastic blade 53 is defined so that by locking the locking arm 52 up to the locked position in the mid-position between the backward and forward positions of the elastic blade 53 and moving the elastic blade 53 forward further, the locking arm 52 may be rocked to the unlocked position again when the elastic blade 53 reaches the forward position. Consequently, the operation of the wiping the head by means of the elastic blade 53 after the carriage is released from being locked can simply be achieved through a series of continuous operations.

A number of embodiments of the present invention have been described. Nevertheless, it will be understood that various modifications may be made without departing from the spirit and scope of the invention. Accordingly, other embodiments are within the scope of the following claims.

What is claimed is:

1. An ink-jet recording apparatus that performs printing of images or characters on a recording medium by moving a carriage for carrying, having a recording head for ejecting ink drops, comprising:

a locking mechanism capable of locking the carriage in a predetermined position, the locking mechanism including a locking lever arm having an engaging portion movable between a locked position where the engaging portion is engaged with the carriage and an unlocked position where the engaging portion is released from the carriage;

an ink suction pump for sucking ink from ink nozzles on a nozzle-forming surface of the recording head while the carriage is set at the predetermined position;

a head wiping member, the head wiping member including an elastic blade movable between a forward position where the head wiping member is in contact with the nozzle-forming surface and a backward position where the head wiping member is away from the nozzle-forming surface for wiping off foreign materials from the nozzle-forming surface of the recording head; and a driving mechanism, the driving mechanism including a motor and a power transmission mechanism for transmitting driving force of the motor to the ink suction pump, the locking lever arm of the locking mechanism and the elastic blade of the head wiping member, the power transmission mechanism having a rotary-motion transmission mechanism for transmitting rotary motion of the motor to the ink suction pump, a first conversion mechanism for converting rotary motion into a reciprocating movement of the elastic blade, and a second conversion mechanism for converting the reciprocating movement into the locking motion of the locking lever arm.

2. The ink-jet recording apparatus of claim 1, wherein the rotary motion of the rotary-motion transmission mechanism is transmitted to the first conversion mechanism by the frictional force exerted by a spring member.

3. An ink-jet recording apparatus that performs printing of images or characters on a recording medium by moving a carriage for carrying, having a recording head for ejecting ink drops, comprising:

a locking mechanism capable of locking the carriage in a predetermined position, the locking mechanism including a locking lever arm having an engaging portion movable between a locked position where the engaging portion is engaged with the carriage and an unlocked position where the engaging portion is released from the carriage;

an ink suction pump for sucking ink from ink nozzles on a nozzle-forming surface of the recording head while the carriage is set at the predetermined position;

a head wiping member, the head wiping member including an elastic blade movable between a forward position where the head wiping member is in contact with the nozzle-forming surface and a backward position where the head wiping member is away from the nozzle-forming surface for wiping off foreign materials from the nozzle-forming surface of the recording head; and a driving mechanism, the driving mechanism including a motor and a power transmission mechanism for transmitting driving force of the motor to the ink suction pump, the locking lever arm of the locking mechanism and the elastic blade of the head wiping member, the power transmission mechanism having a rotary-motion transmission mechanism for transmitting rotary motion of the motor to the ink suction pump, a first conversion mechanism for converting rotary motion into a reciprocating movement of the elastic blade, and a second conversion mechanism for converting the reciprocating movement into the locking motion of the locking lever arm, the rotary motion of the rotary-motion transmission mechanism being transmittable to the first conversion mechanism by frictional force exerted by a spring member, and further comprising a regulator for regulating the locking motion of the locking lever arm so that the locking lever arm rocks from the unlocked position to the locked position while the elastic blade advances to a middle position from the backward position, and so that when the elastic blade advances yet further to the forward position, the locking lever arm rocks to the unlocked position.

4. The ink-jet recording apparatus of claim 3, wherein the rotary-motion transmission mechanism includes a gear train for coupling the motor with the ink suction pump, the first conversion mechanism includes a rotary cam plate which is press-fixed coaxially by the spring force to a driving gear included in the gear train, an arcuate cam groove formed on the side of the rotary cam plate, a cam follower which is slidable in the arcuate cam groove, a reciprocating in connection with the elastic blade and the cam follower, and a guide portion for supporting the reciprocating member between the forward and backward positions so that the reciprocating member may reciprocate linearly.

5. The ink-jet recording apparatus of claim 4, wherein the second conversion mechanism includes a locking-lever engaging portion fitted to the reciprocating member, a locking shaft for supporting the locking lever so as to make the locking lever capable of locking within a predetermined angle range.

6. An ink-jet recording apparatus of claim 4, wherein the ink suction pump includes a circular inner circumferential face, a flexible ink tube which is placed along the circular inner circumferential face, and a rotor supporting a roller so that the roller is rolled along the circular inner circumferential face with pressing the ink tube while the rotor rotates, and wherein the rotor is arranged to be coupled to the driving gear so that the rotor is rotated after the driving gear rotates the rotary cam plate for moving the locking lever up to the locking position by a predetermined angle.

* * * * *